US007482106B2

(12) United States Patent
Yoshizawa et al.

(10) Patent No.: US 7,482,106 B2
(45) **Date of Patent: *Jan. 27, 2009**

(54) IMAGE FORMING METHOD AND IMAGE FORMING APPARATUS

(75) Inventors: Hideo Yoshizawa, Fuchu (JP); Akihiko Itami, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/800,569

(22) Filed: Mar. 15, 2004

(65) Prior Publication Data

US 2005/0202335 A1 Sep. 15, 2005

(51) Int. Cl.
*G03G 13/22* (2006.01)

(52) U.S. Cl. ..... 430/119.71; 430/66; 430/67; 430/108.3; 430/108.4; 430/110.3; 430/119.82; 430/119.85; 430/119.86; 430/123.41; 430/123.42

(58) Field of Classification Search ..... 430/125, 430/124, 110.3, 108.3, 108.4, 66, 67, 119.71, 430/119.85, 119.82, 119.86, 123.41, 123.42, 430/119.72
See application file for complete search history.

(56) References Cited

U.S. PATENT DOCUMENTS 5,438,400 A * 8/1995 Kuribayashi et al. ..... 399/350
5,955,530 A * 9/1999 Inoue et al. ..... 524/493
6,300,027 B1 * 10/2001 Chambers et al. ..... 430/58.2
6,338,929 B1 * 1/2002 Hagi et al. ..... 430/108.4

(Continued)

FOREIGN PATENT DOCUMENTS

JP 09-274417 10/1997
JP 11-249333 9/1999
JP 2001-013732 1/2001

(Continued)

OTHER PUBLICATIONS

Japanese Patent Office machine-assisted translation of JP 09-274417 (pub. Oct. 1997).*

(Continued)

*Primary Examiner*—Janis L Dote
(74) *Attorney, Agent, or Firm*—Lucas & Mercanti, LLP

(57) ABSTRACT

An image forming method comprising steps of forming a toner image by developing by a toner a latent image on a photoreceptor comprised of a layer formed on a substrate, transferring the toner image onto a recording medium on which the toner image is recorded and fixing, wherein the average circular degree of the toner is not less than 0.94, and the toner contains a wax comprising an ester of a carboxylic acid having carbon atoms of not less than 16 or an ester of an alcohol having carbon atoms of not less than 16, and the layer is a layer to be contacted to the toner in the developing step and contains an inorganic fine particles having a number average of primary particle diameter of approximately not less than 1 nm and less than 100 nm.

13 Claims, 3 Drawing Sheets

U.S. PATENT DOCUMENTS

| | | | | |
|---|---|---|---|---|
| 6,569,589 | B2 | 5/2003 | Inaba et al. | |
| 7,285,366 | B2 * | 10/2007 | Itami et al. | 430/56 |
| 2001/0031417 | A1 * | 10/2001 | Nagase et al. | 430/124 |
| 2002/0076636 | A1 * | 6/2002 | Uchida et al. | 430/108.4 |
| 2003/0180646 | A1 * | 9/2003 | Asano et al. | 430/126 |

FOREIGN PATENT DOCUMENTS

| | | | |
|---|---|---|---|
| JP | 2001-265040 | * | 9/2001 |
| JP | 2002108019 | | 4/2002 |
| JP | 2002323785 | | 11/2002 |

OTHER PUBLICATIONS

USPTO English-language translation of JP 2001-265040 (pub. Sep. 2001).*

USPTO English-language translation of JP 09-274417 (pub. Oct. 1997).*

* cited by examiner

IMAGE FORMING METHOD AND IMAGE FORMING APPARATUS

FIELD OF THE INVENTION

This invention relates to an image forming apparatus having a photoreceptor and a toner to be used in an electrophotographic copier, printer and facsimile apparatus and a complex machine having such the functions.

DESCRIPTION OF RELATED ART

Recently, a spherical toner is investigated from the viewpoint of colorization of the image and further improvement of the image quality. However, the spherical toner is difficultly remover by cleaning, and a problem occurs such as passing the toner under the blade when blade cleaning is applied. Some measures have been proposed for solving such the problem.

There is a problem, however, on the durability since a degraded image is caused by lowering of the developer recovering ability when the image formation is repeatedly performed. On the other hand, various investigations such as the addition of fine particles to the photoreceptor layer and the increasing of the molecular weight of the binder resin have been performed corresponding to the requirements for improvement of the durability against the damage and the frictional wear.

In "Image Forming Method and Image Forming Apparatus" disclosed in Japanese Patent Publication Open to Public Inspection, hereinafter referred to as Japanese Patent O.P.I. Publication, No. 11-249333 (claims), the charge transfer material and the developer containing inorganic fine particles are specified.

"Toner, Production Method of Toner and Image Forming Apparatus" disclosed in Japanese Patent O.P.I. Publication No. 2001-13732 (claims) relates to the shape coefficient and the average circular degree of the toner having the toner particle which contains a binder resin, a colorant, wax and a specified organic metal compound.

In "Image Forming Method" disclosed in Japanese Patent O.P.I. Publication No. 9-274427 (claims), the physical properties of the cleaning blade and the elastic rubber blade are specified, by which the toner remaining on the photoreceptor is removed.

The object of the invention is to provide an image forming method and image forming apparatus in which the foregoing problems of the usual technology are solved.

SUMMARY

An image forming method comprising: forming a toner image by developing by a toner a latent image on a photoreceptor comprising a layer formed on a substrate, transferring the toner image onto a recording medium on which the toner image is recorded and fixing, wherein the average circular degree of the toner is not less than 0.94, and the toner contains a wax comprising an ester of a carboxylic acid having carbon atoms of not less than 16 or an ester of an alcohol having carbon atoms of not less than 16, and the layer is a layer to be contacted to the toner in the developing step and contains inorganic particles having a number average of the primary particle diameter of approximately not less than 1 nm and less than 100 nm.

By the above constitution, a toner improved in the transfer ability and the cleaning suitability and a photoreceptor improved in the resistivity against frictional wear can be provided. Moreover, an image forming apparatus can be provided, by which a copy image having a high image quality can be stably obtained for a long period.

DETAILED DESCRITION OF THE EXEMPLARY EMBODIMENTS

Figure 1:
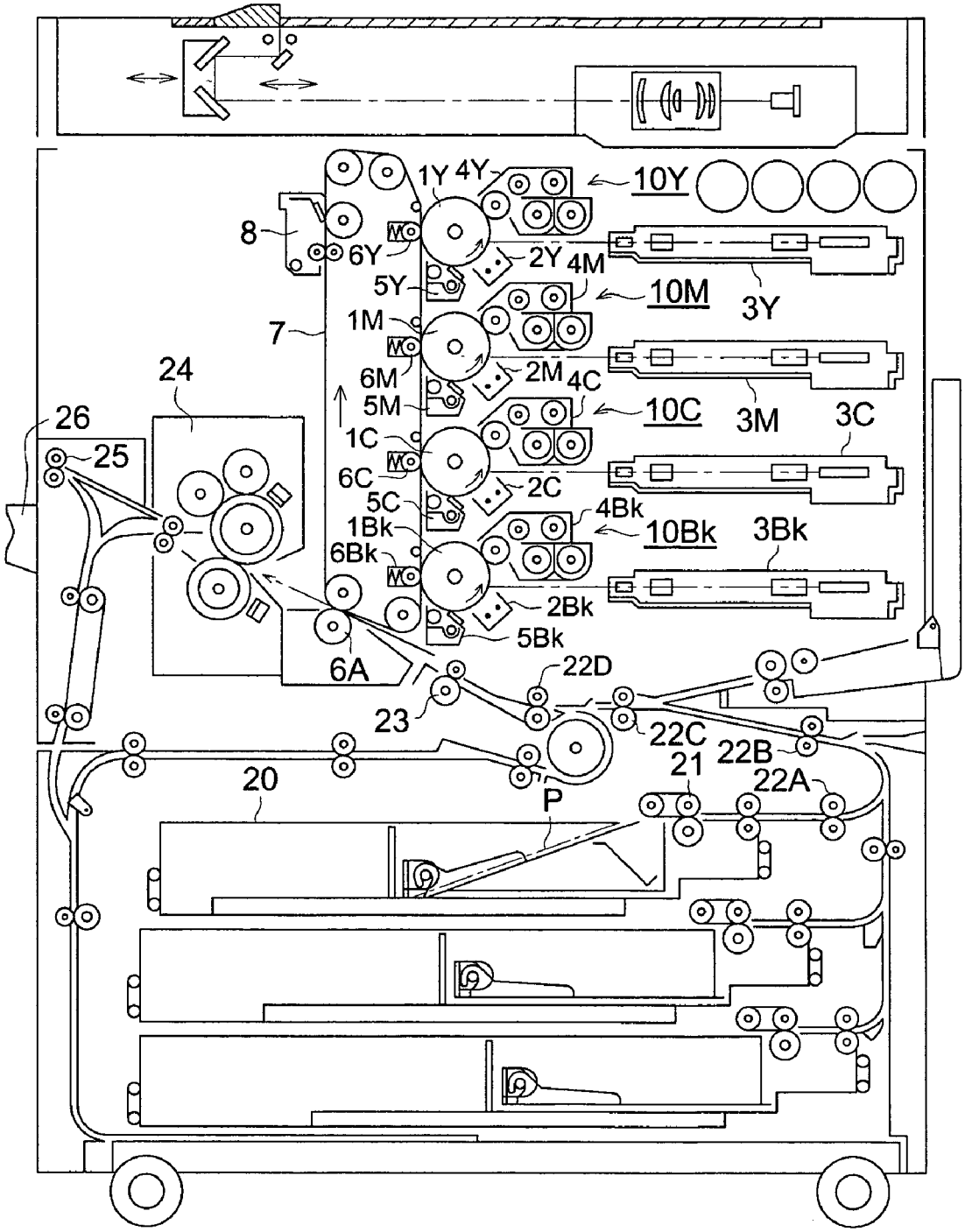
FIG. 1 shows a whole constitution of a color copying machine as an example of image forming apparatus.

The invention is described in detail below. The description does not intend, however, that the invention is limited thereto. Obvious variations and alternations are included in the invention.

It has been found by the invention, particularly when an image is formed by a spherical toner in a apparatus having a cleaning device, that the releasing ability and cleaning suitability of the toner are raised and good properties can be displayed by the combination of addition of fine particles in the photoreceptor and a fatty acid ester wax since a very thin layer of the wax is formed on the surface of the photoreceptor.

It is considered that such the effects are obtained because the wax is more effectively spread when the photoreceptor surface has fine irregularities compared to that the surface is uniform. Particularly, the projections at the photoreceptor surface acts as abrasive for spreading the wax when the projection is an inorganic particle harder than the other portion.

The particle diameter of the inorganic particles is preferably small since the wax is adhered only around the particle so that uniform wax layer cannot be sufficiently formed when the coarse particles are sparsely scattered.

The surface property of the particle and the kind of the binder are also influential factors for raising the uniformity. The dispersibility and the contact ability with the binder of the particle have influence on the potential property, and the particle acts as a trap site in the transition of charge according to the condition of the particle and the interface, consequently an influence such as rising in the remaining potential and lowering in the sensitivity occurs. The present invention is attained according to the above consideration.

Previous to the description of embodiments of the image forming method and the image forming apparatus of the invention, the constitution of an electrophotographic color copying machine is described, in which a photoreceptor and a cleaning means relating to the invention are installed.

The image forming apparatus is one called as a tandem type color image forming apparatus which is constituted by plural units of image forming means 10Y, 10M, 10C and 10Bk, a belt-shaped intermediate transfer member 7 and a fixing device 24.

The image forming unit 10Y for forming a yellow image has a charging means 2Y arranged around a photoreceptor 1Y, an exposing means 3Y, a developing means 4Y, a cleaning means 5Y, and a transfer means 6Y. The image forming unit 10M for forming a magenta image has a photoreceptor 1M, a charging means 2M, an exposing means 3M, a developing means 4M, a cleaning means 5M, and a transfer means 6M. The image forming unit 10C for forming a cyan image has a photoreceptor 1C, a charging means 2C, an exposing means 3C, a developing means 4C, a cleaning means 5C, and a transfer means 6C. The image forming unit 10Bk for forming a black image has a photoreceptor 1Bk, a charging means 2Bk, an exposing means 3Bk, a developing means 4Bk, a cleaning means 5Bk, and a transfer means 6Bk.

The intermediate transferring member 7 is put round on plural rollers and supported so as to be able to round.

Color images each formed by the image forming units 10Y, 10M, 10C and 10Bk are successively transferred (primarily transferred) onto the rounding intermediate transfer member 7 by the transfer means 6Y, 6M, 6C and 6Bk, respectively, to form a synthesized color image. Paper P stored in a paper supplying cassette 20 is supplied by a paper supplying means 21 and conveyed to a transfer means 6A through paper supplying rollers 22A, 22B, 22C and a register roller 23, and the color image is transferred (secondarily transferred) onto the paper P. The paper P on which the color image has been transferred is fixed by the fixing device 24 and held by a paper output roller 25 to be stood onto a paper output tray 26.

Besides, the toner remained on the intermediate transfer member 7 is removed by the cleaning means 8 after the color image is transferred to the paper P and the paper is separated from the intermediate transfer member 7 by curvature of the paper.

Figure 2:
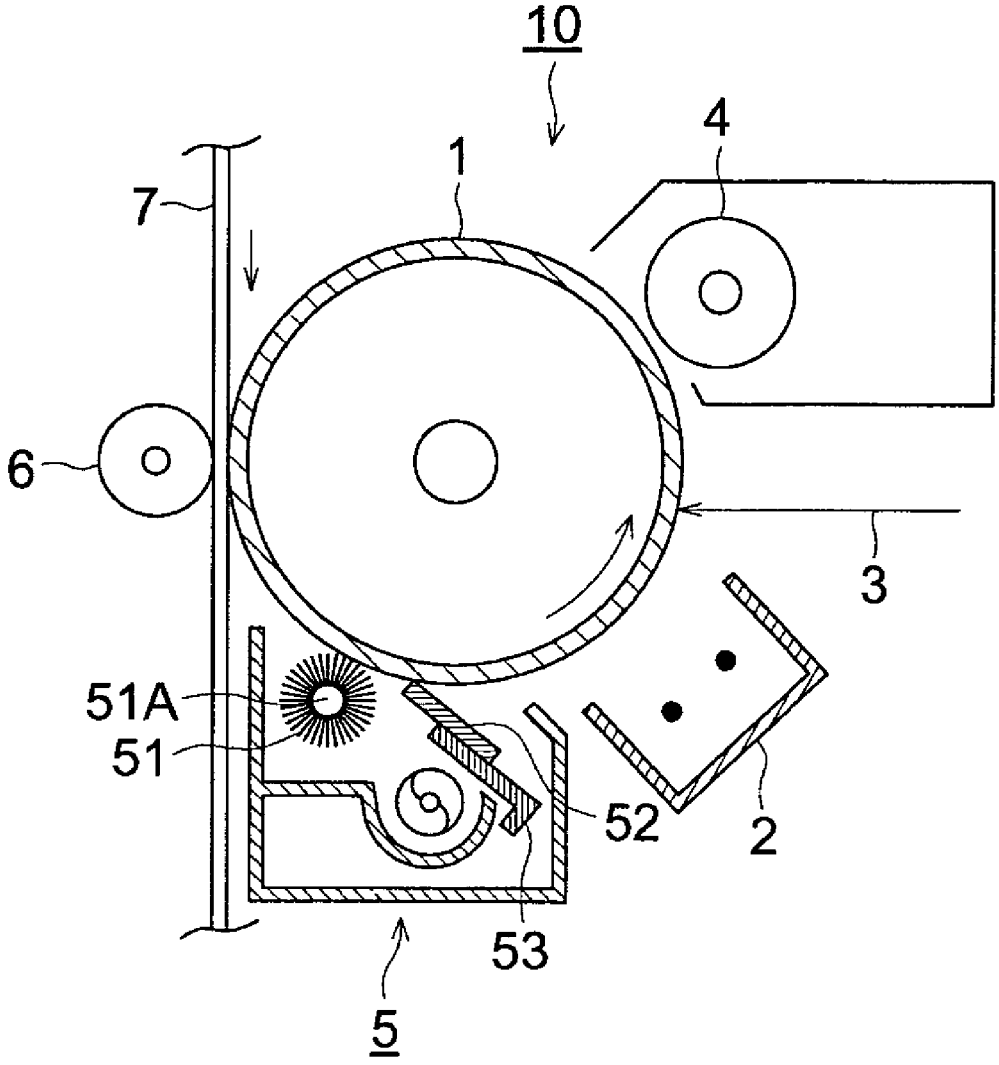
FIG. 2 shows a cross section of the image forming portion of an example image forming apparatus.

FIG. 2 shows a cross section of the image forming unit 10. Hereinafter the image forming unit is referred as "image forming unit 10" since the shapes of the image forming units 10Y, 10M, 10C and 10Bk are the same. The means for constituting the image forming unit 10 are each referred as the photoreceptor 1, charging means 2, exposure means 3, developing device 4, cleaning means 5 and transfer means 6.

The cleaning means 5 remove the toner remained on the photoreceptor 1 by a brush roller 51 and an elastic rubber blade 52 after that the toner image formed on the rotating photoreceptor 1 is transferred onto the paper P.

The touching direction of the elastic rubber blade to the photosensitive layer of the photoreceptor 1 is counter to the rotating direction of the photoreceptor 1.

A function separated type organic photoreceptor including a charge generation material (CGM) and a charge transfer material (CTM) may be used in the image forming method and the image forming apparatus according to the invention.

Figure 3:
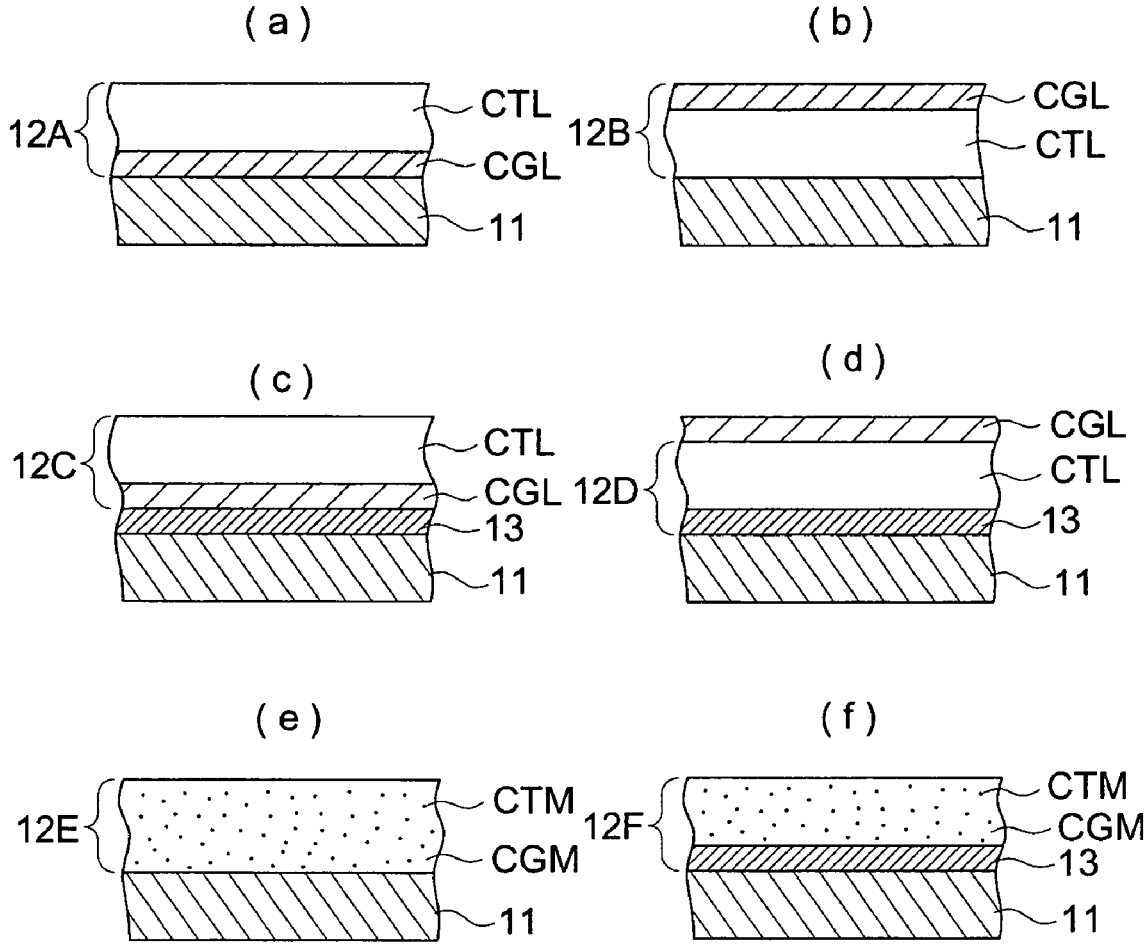
FIG. 3(*a*) through FIG. 3(*f*) are drawings describing an example of the layer structure of a photoreceptor.

FIG. 3 shows drawings describing examples of possible layer constitutions of the photoreceptor; the constitutions are usually those shown in FIG. 3(*a*) through 3(*f*). In the layer constitution shown in FIG. 3(*a*), a charge generation layer CGL is formed on an electric conductive substrate 11 and a charge transfer layer CTL is placed on the CGL to form a photosensitive layer 12A. In FIG. 3(*b*), a photosensitive layer 12B is formed by reversing the order of the charge generation layer CGL and the charge transfer layer CTL. FIG. 3(*c*) shows a photosensitive layer 12C in which an interlayer 13 is provided between the photosensitive layer 12A and the electroconductive substrate 11 of the layer structure shown in FIG. 3(*a*). FIG. 3(*d*) shows a photosensitive layer 12D in which an interlayer 13 is provided between the photosensitive layer 12B and the electroconductive substrate 11 of the layer structure shown in FIG. 3(*b*). FIG. 3(*e*) shows a photosensitive layer 12E in which a photosensitive layer 12E containing the charge generation material CGM and the charge transfer material CTM is formed. FIG. 3(*f*) shows a photosensitive layer 12F in which an interlayer 13 is provided between the photosensitive layer 12E and the electroconductive substrate 11 of the layer structure shown in FIG. 3(*e*).

A protective layer may be provided as the outermost layer of the constitutions shown in FIG. 3(*a*) through (*f*). The protective layer can contains the charge generation material CTM so as to make a two CTL type constitution. When the charge transfer material is contained in the protective layer, such the layer can be regarded as a photosensitive layer.

In the case of that the multi-layered photosensitive layer 12A or 12B is provided on the electroconductive substrate 11 to form the photoreceptor 1 as shown in FIGS. 3(*a*) through (*f*), the charge generation layer CGL 12 can be formed directly or through an adhesion layer or a blocking layer, according to necessity, onto the electroconductive substrate 11 or the charge transfer layer CTL by the following method. Hereinafter, the photosensitive layers 12A through 12F are wholly referred to as the photoreceptor 12.

In the invention, it is preferable that the photoreceptor is one having at least one layer, provisionally referred to as the layer A. The layer A is a layer to be contacted with a toner when a static latent image is formed on the photosensitive layer and the static latent image is developed by the developer containing a toner. The layer A may be either the photosensitive layer or the protective layer. The inorganic fine particle is contained in the layer A. Here, "contain" includes a case in which the particle is completely included in the layer a, a case in which one or more layers, provisionally referred to as layer B, is further provided between the substrate and the layer A and the particle is jointly owned by both the layers A and B, and a case in which the particle is held in a bare state so that the particle is contacted to the toner.

In the invention, the wax contained in the toner is spread as a thin layer on the layer A so as to inhibit any bad influence such as filming by the surface of the layer A, for example, the photosensitive layer 12 has two phases of the inorganic particle and binder each different from the other in the surface properties.

Polymers which are useful as binders employed in the layer A includes, for example, polystyrene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, and melamine resins, and copolymers comprising at least two repeating units thereof. Further, in addition to these insulating resins, cited are polymeric organic semiconductors such as polyvinyl-N-carbazole and the like.

When the inorganic particle is added into the coating liquid of the layer A such as the photosensitive layer, the inorganic particles are usually covered by the binder of the photoreceptor and the initial surface becomes a uniform binder layer in the strict sense of the word. However, the effects is not degraded substantially since the covering by binder is peeled off by several hundreds tines of practical copying.

The number average of primary particle diameter of the inorganic particles is preferably from 1 nm to less than 100 nm. Here, the primary particle diameter is a Fere diameter in the horizontal direction. The determination is carried out by a method in which the photograph of the particles taken by a transmission electron microscope with a magnitude of 50,000 is further enlarged by ten times, and one hundred particles randomly selected and the diameters thereof are measure, and the number average of the measured diameters is calculated.

As the inorganic particle, can be used a fine particle of silica, zinc oxide, titanium oxide, tin oxide, antimony oxide, indium oxide, bismuth oxide, tin-doped indium, antimony-of tantalum-doped tin oxide and zirconium oxide. Among them, silica, particularly hydrophobic silica hydrophobilized at the surface thereof, is preferable from the viewpoint of the cost, easiness of the diameter control and that of the surface treatment.

It is preferable for effectively forming the thin layer that the inorganic fine particles are finely and uniformly dispersed in the layer A. The primary particle diameter of the inorganic fine particles is preferably from 1 nm to 100 nm, and more preferably from 1 nm to 80 nm. Adhesion of the wax can be uniformly prevented and occasion of image defects can be easily prevented.

The surface roughness of the layer A and/or the photosensitive layer is preferably from 0.02 μm to less than 0.1 μm.

A surface roughness (Ra) of a photoreceptor of the invention can be measured by use of an inter-atomic power microscope. The measurement method will be explained below. Inter-atomic power microscope (AMF): scanning type probe microscope SPI3800N, multi-functional unit SPA400 (produced by Seiko Instruments Co., Ltd.), Measurement mode: dynamic force mode (DFM mode), Sensor lever: SI-DF20 (made of silicone having a spring constant of 20 N/m, a characteristic frequency of 135 kHz)
Measurement area: 5.times.5 μm The aforementioned DFM mode is a mode in which a sensor lever is vibrated at a certain frequency (a frequency characteristic to the sensor lever), being intermittently contacted with an approaching sample and a shape of the surface is expressed by a decrease of vibration amplitude. In the DMF mode, since measurement is performed in contactless with the surface of a photoreceptor, the surface of a photoreceptor is never hurt and the measurement can be performed while keeping the original shape of the samples.

Average surface roughness (Ra): represents a center line roughness Ra defined in JIS B601 was extended to three-dimension so that it can be applicable to a measured plane, and is "a value averaging absolute values of a deviation from a standard plane to a specified plane", being expressed by the following equation.

$$Ra = 1/S_0 \int_0^Y \int_0^X |F(X, Y) - Z_0| \, dX \, dY$$

A specified plane is an entire measurement plane and, in the invention, represents a measurement plane (XY plane) of 5 μm square. Entire measurement plane Z is determined according to the following equation:

$$Z=F(X, Y)$$

$S_0$ is determined by the following equation:

$$S_0=X\times Y$$

Standard plane: a plane represented by $Z=Z_0$, wherein average of Z is $Z_0$ $Z_0$ is obtained by the following equation:

$$Z_0 = 1/S_0 \int_0^Y \int_0^X F(X, Y) \, dX \, dY$$

The layer A or the photosensitive layer 12 preferably has a smooth surface as a whole.

When the surface of the photosensitive layer is not smooth, image defects are easily caused.

As the charge generation material to be used in the organic photoreceptor, for example, a phthalocyanine pigment, a polycyclic quinine pigment, an azo pigment, a perylene pigment and an indigoide pigment are usable even though there is no specific limitation.

Particularly, the use of a fluorenone type bis-azo pigment, an imidazolylperylene pigment, an anthoanthrone pigment or an oxytitanyl type phthalocyanine pigment shows considerable improving effects in the sensitivity, durability or image quality. These charge generation materials may be used solely or in combination of two or more kinds thereof.

The developer either may be a one-component developer principally composed of a non-magnetic toner or a magnetic toner, or a two-component developer principally composed of non-magnetic toner and a magnetic carrier. However, the two-component developer is preferred since such the developer is superior in the fluidity and triboelectric property.

The toner for development may be prepared by either a crushing particle forming method or a polymerization particle forming method. In the case of the polymerization method, the toner can be produced by dissolving or dispersing raw materials such as a colorant of the toner, a magnetic fine particle, a charge controlling agent, a mold-releasing agent and a polymerizable resin monomer in a solvent and polymerizing the resin monomer in the raw materials.

Concerning the shape of the toner, the average value of the shape coefficient (average circular degree) according to the following equation is preferably from 0.940 to 1.0, and more preferably from 0.960 to 0.99.

Shape coefficient=(Circumference length of the circle calculated from the circle equivalent diameter)/(Circumference length of projection image of the particle)

In the above, the circumference length of the projection image of the particle is measured on an electron microscopic photograph of the toner particles taken with a magnitude of 2000 times by using Scanning Image Analyzer, manufactured by Nihon Denshi Co., Ltd.

The circle equivalent diameter is the diameter of a circle having an area the same as that of the projected image of the toner particle.

It is preferable that the distribution of the shape coefficient is sharp, the standard deviation of the circular degree is preferably not more than 0.10 and a CV value calculated by the following equation is preferably less than 20%, and more preferably less than 10%.

*CV* value=[(Deviation of circular degree)/(Average circular degree)]×100

The transferring ability can be improved by making the average circular degree so as to be not more than 0.990. The average circular degree of not less than 0.940 means that the shape of the particle is not extreme irregular, and the crush of the particle caused by the stress during the use for a long period can be inhibited.

The sharp distribution of the shape coefficient is preferred, and the toner composed of the particles each having similar shape can be prepared by making the standard deviation of the circular degree to not more than 0.10. Consequently, the difference of the fixing ability between the individual particles can be reduced and the prevention effect to the contamination of fixing device is enhanced by the improvement of the fixing ratio and the lowering of the off-set phenomenon.

Examples of the wax to be used in the toner include pentaerythrytol tetrastearate, pentaerythrytol tetrabehenate, pentaerythrytol dibehenate, pentaerythrytol tribehenate, neopentyl glycol dibehenate, a condensation product of nonanediol, sebacic acid and stearyl alcohol, and a condensation compound of decanediol, azelaic acid and stearyl alcohol.

Typical waxes are listed below.

(1)

$$CH_3-(CH_2)_{12}-COO-(CH_2)_{15}-CH_3$$

(2)

$$CH_3-(CH_2)_{18}-COO-(CH_2)_{17}-CH_3$$

(3)

$$CH_3-(CH_2)_{20}-COO-(CH_2)_{21}-CH_3$$

(4)

$$CH_3-(CH_2)_{14}-COO-(CH_2)_{19}-CH_3$$

(5)

$$CH_3-(CH_2)_{20}-COO-(CH_2)_6-O-CO-(CH_2)_{20}-CH_3$$

(6)

$$CH_3-(CH_2)_{20}-COO-(CH_2)_2-\overset{\overset{CH_3}{|}}{CH}-CH_2-O-CO-(CH_2)_{20}-CH_3$$

(7)

$$CH_3-(CH_2)_{22}-COO-(CH_2)_2-\overset{\overset{CH_3}{|}}{CH}-CH_2-O-CO-(CH_2)_{22}-CH_3$$

(8)

$$CH_3-(CH_2)_{22}-COO-CH_2-\underset{\underset{CH_3}{|}}{\overset{\overset{CH_3}{|}}{C}}-CH_2-O-CO-(CH_2)_{22}-CH_3$$

(9)

$$CH_3-(CH_2)_{26}-COO-CH_2-\underset{\underset{CH_3}{|}}{\overset{\overset{CH_3}{|}}{C}}-CH_2-O-CO-(CH_2)_{26}-CH_3$$

(10)

$$\begin{array}{l} CH_2-O-CO-(CH_2)_{26}-CH_3 \\ | \\ CH-O-CO-(CH_2)_{26}-CH_3 \\ | \\ CH_2-O-CO-(CH_2)_{26}-CH_3 \end{array}$$

(11)

$$\begin{array}{l} CH_2-O-CO-(CH_2)_{22}-CH_3 \\ | \\ CH-O-CO-(CH_2)_{22}-CH_3 \\ | \\ CH_2-O-CO-(CH_2)_{22}-CH_3 \end{array}$$

(12)

$$\begin{array}{l} CH_2-OH \\ | \\ CH-O-CO-(CH_2)_{26}-CH_3 \\ | \\ CH_2-O-CO-(CH_2)_{26}-CH_3 \end{array}$$

(13)

$$\begin{array}{l} CH_2-OH \\ | \\ CH-O-CO-(CH_2)_{22}-CH_3 \\ | \\ CH_2-O-CO-(CH_2)_{22}-CH_3 \end{array}$$

(14)

$$\begin{array}{l} CH_2-OH \\ | \\ CH-OH \\ | \\ CH_2-O-CO-(CH_2)_{26}-CH_3 \end{array}$$

(15)

$$\begin{array}{l} CH_2-OH \\ | \\ CH-OH \\ | \\ CH_2-O-CO-(CH_2)_{22}-CH_3 \end{array}$$

(16)

$$CH_3-(CH_2)_{26}-COO-CH_2-\underset{\underset{CH_2-O-CO-(CH_2)_{26}-CH_3}{|}}{\overset{\overset{CH_3}{|}}{C}}-CH_2-O-CO-(CH_2)_{26}-CH_3$$

(17)

$$CH_3-(CH_2)_{20}-COO-CH_2-\underset{\underset{CH_2-O-CO-(CH_2)_{20}-CH_3}{|}}{\overset{\overset{CH_2CH_3}{|}}{C}}-CH_2-O-CO-(CH_2)_{20}-CH_3$$

(18)

$$CH_3-(CH_2)_{26}-COO-CH_2-\underset{\underset{CH_2-O-CO-(CH_2)_{26}-CH_3}{|}}{\overset{\overset{CH_2-O-CO-(CH_2)_{26}-CH_3}{|}}{C}}-CH_2-O-CO-(CH_2)_{26}-CH_3$$

(19)

$$CH_3-(CH_2)_{20}-COO-CH_2-\underset{\underset{CH_2-O-CO-(CH_2)_{20}-CH_3}{|}}{\overset{\overset{CH_2-O-CO-(CH_2)_{20}-CH_3}{|}}{C}}-CH_2-O-CO-(CH_2)_{20}-CH_3$$

(20)

$$CH_3-(CH_2)_{18}-COO-CH_2-\underset{\underset{CH_2-O-CO-(CH_2)_{18}-CH_3}{|}}{\overset{\overset{CH_2-O-CO-(CH_2)_{18}-CH_3}{|}}{C}}-CH_2-O-CO-(CH_2)_{18}-CH_3$$

(21)

$$CH_3-(CH_2)_{16}-COO-CH_2-\underset{\underset{CH_2-O-CO-(CH_2)_{16}-CH_3}{|}}{\overset{\overset{CH_2-O-CO-(CH_2)_{16}-CH_3}{|}}{C}}-CH_2-O-CO-(CH_2)_{16}-CH_3$$

(22)

$$CH_3-(CH_2)_{20}-COO-CH_2-\underset{\underset{CH_2-O-CO-CH_3}{|}}{\overset{\overset{CH_2-O-CO-CH_3}{|}}{C}}-CH_2-O-CO-CH_3$$

(23)

$$CH_3-(CH_2)_{20}-COO-CH_2-\underset{\underset{CH_3}{|}}{\overset{\overset{CH_3}{|}}{C}}-CH_2-O-CO-(CH_2)_{20}-CH_3$$

(24)

$$CH_3-(CH_2)_{16}-OCO-(CH_2)_8-COO(CH_2)_3-O-CO-(CH_2)_8-COO(CH_2)_{16}CH_3$$

(25)

$$CH_3-(CH_2)_{10}-COO-(CH_2)_{11}-CH_3$$

The toner may contain a fatty acid metal salt. Examples of the fatty acid metal salt include aluminum stearate, calcium stearate, potassium stearate, magnesium stearate, barium stearate, lithium stearate, zinc stearate, copper stearate, lead stearate, nickel stearate, strontium stearate, cobalt stearate, cadmium stearate, zinc oleate, manganese oleate, iron oleate, cobalt oleate, copper oleate, magnesium oleate, lead oleate, zinc palmitate, cobalt palmitate, copper palmitate, magnesium palmitate, aluminum palmitate, calcium palmitate, zinc linolate, cobalt linolate, calcium linolate, zinc ricinolate, cadmium ricinolate and lead caproate. The using amount is from 0.01 to 10%, and preferably from 0.1 to 5%, by weight of the toner.

The cleaning means is described below.

As the brush material of the brush roller 51, a fiber formable polymer having high dielectric constant is preferably used even though optional ones may be used. Examples of such the polymer include rayon, nylon, polycarbonate, polyester, methacryl resin, acryl resin, poly(vinyl chloride), poly (vinylidene chloride), polypropylene, polystyrene, poly(vinyl acetate), styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin and poly(vinyl acetal) such as poly(vinyl butyral). Rayon, nylon, polyester, acryl resin and polypropylene are particularly preferred.

The brush roller 51 may either be electroconductive or non-electroconductive. One adjusted to an optional resistivity by adding a low conductive material such as carbon to the constitution material.

The thickness of the single fiber of the brush is from 6 denier to 30 denier. When the thickness is less than 6-denier, substance adhered to the surface cannot be removed since the frictional force is insufficient. When the thickness is more than 30 denier, the fiber damages the surface of the surface of the photoreceptor and shortens the life of the photoreceptor since the fiber is made too hard.

The "denier" is a value represented by the weight in gram of 9,000 meter of the fiber constituting the brush. The density of the fiber of the brush roller 51 is preferably from $4.5\times10^2$ f/cm$^2$ to $15.5\times10^2$ f/cm$^2$. When the density is within the range, the adhered substance on the photoreceptor is uniformly removed and the toner and a foreign substance come between the brush fibers can be removed to inhibit packing and maintain the properties of the brush.

As the substrate of the brush roller, a metal such as stainless steel and aluminum, paper and plastic are principally used. However, the material is not limited to the above.

A means (flicker) may be provided according to necessity for striking down the toner and the foreign material adhered to the brush roller 51 from the brush.

The brush is preferably constituted by a cylindrical supporting means 51A and a far brush provided thereon through an adhering layer as shown in FIG. 2.

The cleaning means may have an elastic rubber blade 52. It is preferable that the elastic rubber blade 52 is provided on the supporting member 53 so as to have a free edge.

The pressing force of the elastic rubber blade 52 to the surface layer of the photoreceptor 1 is preferably within the range of from 5 g/cm to 30 g/cm. Cleaning is sufficiently carried out and the passing of the toner is effectively provided by applying the pressure within the above range. Moreover, the frictional wearing speed of the photoreceptor can be inhibited, the lowering of the sensitivity of the photoreceptor is inhibited so as to effectively inhibit occurrence of inferior image such as fogging.

The free edge of the elastic rubber blade 52 is touched by pressure in the counter direction to the rotating direction of the photoreceptor 1.

The elastic rubber blade 52 preferably has a rubber hardness of from 60° to 70° according to JISA, a repulsion elasticity of from 30 to 60 kgf/cm$^2$, a thickness of from 1.5 mm to 3.0 mm and a free length of from 7 to 12 mm, even though they are not specifically limited.

EXAMPLE

The invention is concretely described below referring examples, but the embodiment of the invention is not limited thereto.

[Preparation of Photoreceptor 1]

Photoreceptor 1 was prepared as follows.

<Electroconductive Substrate>

The surface of a cylindrical aluminum substrate having a diameter of 80 mm and a length of 346 mm was subjected to treatment so as to prepare an electroconductive substrate having a surface roughness Rz of 0.9 μm.

<Interlayer>

The following dispersion for interlayer was diluted by 2 times by the same mixed solvent and filtered by Ridimesh 5 μm filter, manufactured by Nihon Paul Co., Ltd., after standing for one night to prepare an interlayer coating liquid.

| | |
|---|---|
| Polyamide resin CM8000 (Toray Co., Ltd.) | 1 part |
| Titanium oxide (titanium oxide particles having a number average primary particle diameter, which was subjected to a primary treatment by silica · alumina and a secondary treatment by methylhydrogenpolysiloxane) | 3 parts |
| Methanol | 10 parts |

The mixture was dispersed for 10 hours by a sand mill as a dispersing machine.

The above interlayer coating liquid was coated on the substrate so as to form a layer having a dry thickness of 2 μm.

| <Charge generation layer (CGL)> | |
|---|---|
| Y-type titanylphthalocyanine (titanylphthalocyanine having the maximum peak of Bragg's angle (±0.2°) 2θ of 27.2° in the Cu—Kα characteristic X-ray diffraction spectrum) | 20 parts |
| Poly(vinyl butyral) resin #6000-C (Denkikagaku Kogyo Co., Ltd.) | 10 parts |
| t-butyl acetate | 700 parts |
| 4-methoxy-4-methyl-2-pentanone | 300 parts |

The above components were mixed and dispersed by a sand mill for 10 minutes to prepare a charge generation layer coating liquid. The coating liquid was coated onto the interlayer by a dipping coating method so as to form a charge generation layer having a thickness of 0.3 μm.

| <Charge transfer layer (CTL)> | |
|---|---|
| Charge transfer material: 4,4'-dimethyl-4''-(α-phenylstyryl)triphenylamine | 225 parts |
| Polycarbonate (Polycarbonate Z, molecular weight: 30,000) | 300 parts |
| Antioxidant: IRGANOX 1010 (Nihon Ciba-Geigy) | 6 parts |
| 1,3-dioxolane | 2000 parts |
| Methyl-phenyl polysiloxane | 1 part |

The above components were mixed and dissolved to prepare a charge transfer layer coating liquid. The coating liquid was coated by a dipping method on the charge generation layer so as to form a charge transfer layer having a dry thickness of 20 μm.

| <Surface layer> | |
|---|---|
| Charge transfer material: 4,4'-dimethyl-4''-(α-phenylstyryl)triphenylamine | 225 parts |
| Polycarbonate (polycarbonate A composed of the following structural unit, molecular weight: 30,000, water absorbing ratio: 0.25%) | 300 parts |
| Hydrophobic silica | Table 1 |
| Hindered amine antioxidant | 6 parts |
| 1,3-dioxoran | 2000 parts |
| Methyl-phenyl polysiloxane | 1 part |

The above components were dispersed while circulating by a circulation dispersing apparatus capable of irradiating ultrasonic wave to prepare a surface layer coating liquid. The coating liquid was coated on the charge transfer layer by a circle-shaped coating amount controlling method so as to form a layer having a dry thickness of 5 μm, and dried at 110° C. for 70 minutes to prepare Photoreceptor 1. The surface roughness Ra of thus obtained photoreceptor was 0.07 μm. Photoreceptors listed in Table 1 were prepared in the same manner in each of which various kinds of inorganic fine particles were individually added.

TABLE 1

Polycarbonate A

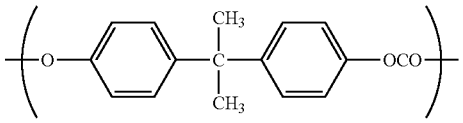

| Photo-receptor No. | Number average primary particle diameter of hydrophobic silica (nm) | Adding amount of hydrophobic silica | Treating agent for hydrophobic silica | Hydro-phobic degree of hydro-phobic silica (%) |
|---|---|---|---|---|
| OPC-1 | 60 | 10 | Dimethylsilicone | 76 |
| OPC-4 | 80 | 10 | Methacryloxysilane | 72 |
| OPC-6 | 12 | 45 | Dimethyldichlorosilane | 71 |
| OPC-3 | 20 | 10 | None | 0 |
| OPC-5 | 120 | 20 | Hexamethyldisilazane | 72 |
| OPC-2 | 5 | 10 | Hexamethyldisilazane | 75 |

Preparation Example of 1

Into a 5000 ml separable flask, on which a stirring device, a thermal sensor, a cooler and a nitrogen gas introducing device were attached, a solution of 7.08 g of an anionic surfactant (sodium dodecylbenzenesulfonate: SDS) dissolved in 2760 g of ion exchanged water was previously charged. The interior temperature of the flask was raised by 80° C. while stirring the solution at a stirring speed of 230 rpm under a nitrogen gas stream. On the other hand, 72.0 g of Exemplified Compound (19) was added to monomer mixture composed of 115.1 g of styrene, 42.0 g of n-butyl acrylate and 10.9 g of methacrylic acid and heated by 80° C. and dissolved to prepare a monomer solution.

The above heated solutions were mixed and dispersed by a mechanical dispersing apparatus having a circulation pass to prepare an emulsified particles having uniform diameter. To the emulsion, a solution of 0.84 g of polymerization initiator (potassium persulfate) dissolved in 200 g of ion-exchanged water was added. Then the emulsion was heated and stirred at 80° C. for 3 hours to prepare latex particles. Thereafter, a solution of 7.73 g of the polymerization initiator dissolved in 240 ml of ion-exchanged water was added. After 15 minutes, a mixture of 383.6 g of styrene, 140.0 g of n-butyl acrylate, 36.4 g of methacrylic acid and 13.7 g of thioglycerol was dropped at 80° C. spending for 126 minutes. After finish of the dropping, the liquid was heated and stirred for 60 minutes, and then cooled by 40° C. Thus latex particles were obtained. The latex particles were referred to as Latex 1.

Preparation Example of Latex 2

A latex particle was prepared in the same manner as in the latex preparation example 1 except that 15.0 g of ethyl thioglycolate and 120.0 g of Exemplified Compound (18) were each used in place of thioglycerol and Exemplified Compound (19), respectively. The product was referred to as Latex 2.

Latexes 3 and 4 were prepared by in the same manner as in the latex preparation example 2 except that Exemplified Compounds (1) and (25) were each used in place of Exemplified Compound (18), respectively.

Example of Preparation of Toner

<Preparation of Colored Particle 1>

In 160 ml of ion-exchanged water, 9.2 g of sodium n-dodecylsulfate was dissolved. To this solution, 20 g of carbon black REGAL 330R (Cabot Co., Ltd.) was gradually added and dispersed by using CLEAMIX. The particle size of the dispersion was measured by an electrophoresis light scattering photometer FLS-800 manufactured by Ootsuka Denshi Co., Ltd. The weight average particle diameter was 112 nm. This dispersion was referred to as Colorant Dispersion 1.

Into a 5 liter four mouth flask, on which a temperature sensor, a cooler, a nitrogen gas introducing device and a stirring device were attached, 1250 g of the foregoing Latex 1, 2000 ml of ion-exchanged water and Colorant Dispersion 1 were charged and stirred. After adjusted to 30° C., a 5 moles per liter aqueous solution of sodium hydroxide was added to adjust the pH of the mixture at 10.0. Then an aqueous solution of 52.6 g of magnesium hexahydrate dissolved in 72 ml of ion-exchanged water was added at 30° C. spending 10 minutes while stirring.

TABLE 2

| Colored particle | Latex | Temperature ° C. (± 0.2° C.) | Heating and stirring time (Hours) |
|---|---|---|---|
| Colored Particle 2 | Latex 2 | 87 | 6 |
| Colored Particle 3 | Latex 3 | 83 | 6 |
| Colored Particle 4 | Latex 4 | 90 | 6 |
| Colored Particle 5 | Latex 3 | 80 | 5 |
| Colored Particle 6 | Latex 3 | 90 | 6 |

After standing for 3 minutes, the liquid was heated and the liquid temperature was raised by 90° C. spending 6 minutes (temperature raising rate=10° C./minute). In such the situation, the particle diameter was measured by COULTER COUNTER TA-II (registered trade name), and an aqueous solution of 115 g of sodium chloride dissolved in 700 ml of ion-exchanged water was added to stop the growing of the particle when the volume average diameter was become to 6.5 μm. Heating and stirring were further continued for 6 hours at 90° C.±2° C. for desalting out and fusion-adhering the particles. Thereafter, the dispersion was cooled by 30° C. in a rate of 6° C./minute and then hydrochloric acid was added to adjust the pH value to 2.0 and stirring was stopped. The formed colored particles were filtered and repeatedly washed by ion-exchanged water and dried by heated air at 40° C. to prepare colored particles. Thus obtained colored particle was referred to as Colored Particle 1.

Colored Particles 2 through 5 were prepared in the same manner as in Colored Particle 1 except that Latex 2 through 4 were each used in place of Latex 1.

To each of thus obtained colored particles, 1% by weight of hydrophobic silica (number average primary particle diameter: 12 μm, and hydrophobic degree: and hydrophobic degree: 68) and 1% by weight of hydrophobic titanium oxide (number average primary particle diameter: 20 μm, hydrophobic degree: 63) were added, and the fatty acid metal salt shown in Table 3 was added and mixed by a HENSCHEL MIXER to prepare Toners 1 through 6.

Silicone resin coated ferrite carrier having a volume average particle diameter of 60 μm was mixed with each of thus obtained toners to prepare developers each having a toner concentration of 6%. These developers were each referred to as Developer 1 through 6 corresponding to the toners.

[Circular Degree of Toner]

The circular degree of the toner is expressed by the quotient of the circumference length of a circle having the area the same as the area of projection image of the particle divided by the length of the circumference length of the projection image of the particle, and shows irregularity of the toner shape. The circular degree is 1.000 when the toner is true sphere, and the value is lowered accompanied with rising of complexity of the surface shape. The average circular degree is an average value of the frequency distribution of the circular degree.

[Image Evaluation]

Modified one of digital copying machine SITIOS 7165, manufactured by Konica Corp., was used for image evaluation. The image evaluation machine had the processes of corona charging, laser exposure, reversal development, static image transfer, separation by claw, and cleaning by blade with cleaning assisting brush roller.

Photoreceptors 1 through 6 were each installed and Developer 1 through 6 were each charged into the image evaluation machine for subjecting to the evaluation. The evaluation on the cleaning property and the image were carried out by copying an original image onto A4 size neutral paper. The original image was divided into four areas and on each of which an character image having a pixel ratio of 7%, a portrait photograph, a solid white image and a solid black image were arranged, respectively. At a high temperature (30° C.) and a high moisture (80% RH), which were considered as the most serious conditions, 100,000 sheets of copies were continuously taken and the following evaluations were performed.

<Evaluation of Damage>

After 100,000 sheets copying, the deepness of damages formed on the surface of the photoreceptor was measured by

TABLE 3

| | | OPC | | | | Toner | | | | | |
|---|---|---|---|---|---|---|---|---|---|---|---|
| | | | | | | Wax | | | | | |
| | | Inorganic particle | Hydrophobic treatment | Particle diameter nm | Surface roughness Ra | Carboxylic acid C | Alcohol | Average circular degree | Fatty acid metal salt content | Blade | Brush roller |
| Example 1 | OPC-1 Toner 1 | Contained | Treated | 60 | 0.07 | 22 Compound (19) | 5 | 0.96 | Zn-St 0.2% | Used | Used |
| Example 2 | OPC-1 Toner 2 | Contained | Treated | 60 | 0.07 | 28 Compound (18) | 5 | 0.95 | Zn-St 0.2% | Used | Used |
| Example 3 | OPC-1 Toner 3 | Contained | Treated | 60 | 0.07 | 14 Compound (1) | 16 | 0.94 | — | Used | Used |
| Example 4 | OPC-2 Toner 1 | Contained | Treated | 5 | 0.20 | 22 | 5 | 0.96 | Zn-St 0.1% | Used | — |
| Example 5 | OPC-3 Toner 1 | Contained | None | 20 | 0.15 | 22 | 5 | 0.96 | Zn-St 0.1% | Used | — |
| Example 6 | OPC-4 Toner 1 | Contained | Treated | 80 | 0.08 | 22 | 5 | 0.96 | — | Used | Used |
| Example 7 | OPC-6 Toner 6 | Contained | Treated | 12 | 0.20 | 14 | 16 | 0.96 | — | Used | — |
| Comparative example 1 | OPC-5 Toner 2 | Contained | Treated | 120 | 0.20 | 28 | 5 | 0.95 | — | Used | — |
| Comparative example 2 | OPC-6 Toner 3 | None | Treated | — | 0.10 | 14 | 16 | 0.94 | — | Used | — |
| Comparative example 3 | OPC-2 Toner 4 | Contained | Treated | 5 | 0.15 | 12 | 12 | 0.97 | — | Used | — |
| Comparative example 4 | OPC-2 Toner 5 | Contained | Treated | 60 | 0.30 | 14 | 16 | 0.91 | — | Used | — |

a laser microscope. The laser microscope was LASERTECH 1LM21W (registered trade name).

The circumference surfaces of the photoreceptor drum was examined by the microscope having an objective lens with a magnitude of 20 at the positions each far from the both end of the drum by 70 cm and the central position of the drum, and the maximum value of the damage within the visual field was subjected to the evaluation. Moreover, when a specific deep damage was visibly found, the image was subjected to the evaluation.

D: $R_{max}$ was more than 2.5 μm

C: $R_{max}$ was not more than 2.5 μm and less than 2.0 μm.

B: $R_{max}$ was not more than 2.0 μm and less than 1.5 μm.

A: $R_{max}$ was not more than 1.5 μm, satisfactory level.

<Evaluation of Cleaning>

The copy images of 100,000 sheets were wholly examined.

D: Image defects caused by the passing of the toner were found in 501 or more copies, the level of the defect occurrence made problems for practical use.

C: Image defects caused by the passing of the toner were found in form 101 to 500 copies, re-examination was necessary to decide the suitability for practical used.

B: Image defects caused by the passing of the toner were found in form 31 to 100 copies, the level of the defect occurrence was made no problem for practical use.

A: Image defects caused by the passing of the toner were found in less than 30 copies, satisfactory level.

<Evaluation of Filming>

The filming on the photoreceptor surface was evaluated by observation of the photoreceptor surface by the laser microscope, LASERTECH 1LM21W (registered trade name) at each the finish times of continuous 50,000 copies and 100,000 copies.

D: Considerable foreign matters were adhered after 50,000 copies or 100,000 copies.

C: No matter was adhered after 50,000 copies, but foreign matters were adhered after 100,000 copies.

B: A few foreign matters were adhered after 100,000 copies.

A: Adhered foreign matters after 100,000 copies were little.

Results of the evaluations on the damage, cleaning and filming were listed in Table 4.

TABLE 4

| | Evaluation on damage | Evaluation on cleaning | Evaluation on filming |
|---|---|---|---|
| Example 1 | A | A | A |
| Example 2 | A | A | A |
| Example 3 | A | B | B |
| Example 4 | A | B | C |
| Example 5 | B | C | C |
| Example 6 | A | B | B |
| Example 7 | B | B | C |
| Comparative example 1 | B | D | B |
| Comparative example 2 | D | B | B |
| Comparative example 3 | A | C | D |
| Comparative example 4 | A | C | D |

The cleaning ability and the filming property of the toner with high circular degree can be improved and the image can be stably obtained for a long period by the image forming apparatus according to the invention.

What is claimed is:

1. An image forming method comprising:

forming a toner image by developing with a developer containing a toner a latent image on a photoreceptor comprising a layer formed on or over a substrate;

transferring the toner image to a recording medium on which the toner image is recorded; and fixing the toner image;

removing the toner remained in the photoreceptor by a cleaning device;

wherein the average circular degree of the toner is not less than 0.94;

the toner contains a wax comprising an ester of a carboxylic acid having carbon atoms of not less than 16 or an ester of an alcohol having carbon atoms of not less than 16;

the toner contains a metal salt of fatty acid in an amount of from 0.01 to 10% by weight;

the layer contains hydrophobic silica particles having a number average of primary particle diameter in the range of about 1 nm or more and less than 100 nm; and the surface roughness Ra of the layer is not less than 0.02 μm and less than 0.1 μm.

2. The image forming method of claim 1, wherein the cleaning device is a cleaning blade that touches the photoreceptor.

3. The image forming method of claim 2, wherein the cleaning blade is disposed so as to contact to the photoreceptor in the counter direction to the rotating direction of the photoreceptor.

4. The image forming method of claim 2, wherein the blade is an elastic rubber blade and the pressure of the elastic rubber blade to the photoreceptor is from 5 g/cm to 30 g/cm.

5. The image forming method of claim 1, wherein the cleaning device is a brush roller that touches the photoreceptor with fiber and the thickness of the fiber of the brush roller is from 6 denier to 30 denier.

6. The image forming method of claim 1, wherein the cleaning device is a brush roller that touches the photoreceptor with fiber and the density of the fiber of the brush roller is from $4.5\times10^2$ f/cm$^2$ to $15.5\times10^2$ f/cm$^2$.

7. The image forming method of claim 1, wherein the toner has an average circular degree of from 0.96 to 0.99.

8. The image forming method of claim 1, wherein the standard deviation of the circular degree is not more than 0.10.

9. The image forming method of claim 1, wherein the wax contains at least one of pentaerythrytol tetrastearate, pentaerythrytol tetrabehenate, pentaerythrytol dibehenate, pentaerythrytol tribehenate, neopentyl glycol dibehenate, a condensation product of nonanediol, sebacic acid and stearyl alcohol, and a condensation compound of decanediol, azelaic acid and stearyl alcohol.

10. The image forming method of claim 1, wherein the method comprises the steps of:

forming a plurality of latent images on a plurality of photoreceptors, each of said latent images formed on one of said photoreceptors and each of said photoreceptors is a photoreceptor of claim 1, forming a plurality of toner images by developing each of said latent images with the toner of claim 1; and transferring the toner images onto the recording medium.

11. The image forming method of claim 1, wherein the layer contains the hydrophobic silica particles having a number average primary particle diameter of from 1 nm to less than 100 nm.

12. The image forming method of claim 1, wherein the cleaning device comprises an elastic rubber blade and removing the toner remained on the photoreceptor is carried out by touching the elastic rubber blade to the photoreceptor.

13. The image forming method of claim 1, wherein the metal salt of fatty acid contains at least one of aluminum stearate, calcium stearate, potassium stearate, magnesium stearate, barium stearate, lithium stearate, zinc stearate, copper stearate, lead stearate, nickel stearate, strontium stearate, cobalt stearate, cadmium stearate, zinc oleate, manganese oleate, iron oleate, cobalt oleate, copper oleate, magnesium oleate, lead oleate, zinc palmitate, cobalt palmitate, copper palmitate, magnesium palmitate, aluminum palmitate, zinc linolate, cobalt linolate, calcium linolate, zinc ricinolate, cadmium ricinolate and lead caproate.

* * * * *